US010326197B2

(12) United States Patent
Davis

(10) Patent No.: US 10,326,197 B2
(45) Date of Patent: Jun. 18, 2019

(54) RADIO FREQUENCY IDENTIFICATION (RFID) TAG DEVICE AND RELATED METHODS

(71) Applicant: SEMICONDUCTOR COMPONENTS INDUSTRIES, LLC, Phoenix, AZ (US)

(72) Inventor: Timothy Jordan Davis, Phoenix, AZ (US)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 15/474,938

(22) Filed: Mar. 30, 2017

(65) Prior Publication Data

US 2018/0069291 A1 Mar. 8, 2018

Related U.S. Application Data

(60) Provisional application No. 62/383,226, filed on Sep. 2, 2016.

(51) Int. Cl.

| | |
|---|---|
| ***H01Q 1/22*** | (2006.01) |
| ***H01Q 1/24*** | (2006.01) |
| ***H01Q 1/48*** | (2006.01) |
| ***H01Q 7/00*** | (2006.01) |
| ***H01Q 9/06*** | (2006.01) |

(Continued)

(52) U.S. Cl.

CPC ..... *H01Q 1/2225* (2013.01); *H01Q 1/243* (2013.01); *H01Q 1/48* (2013.01); *H01Q 9/065* (2013.01); *H01Q 9/24* (2013.01); *H01Q 5/364* (2015.01); *H01Q 7/00* (2013.01); *H01Q 9/26* (2013.01)

(58) Field of Classification Search

None

See application file for complete search history.

(56) References Cited

U.S. PATENT DOCUMENTS 6,285,342 B1 * 9/2001 Brady ..... G06K 19/07749 343/895

8,169,322 B1 5/2012 Zhan (Continued)

FOREIGN PATENT DOCUMENTS

| | | | |
|---|---|---|---|
| CN | 203012771 | U | 6/2013 |
| CN | 104978600 | A | 10/2015 |
| WO | 2015037667 | A1 | 3/2015 |

OTHER PUBLICATIONS

"Signal strength readout and miniaturised antenna for metal-mountable UHF RFID threshold temperature sensor tag," Toni Björninen; Fan Yang, Electronics Letters Year: 2015, vol. 51, Issue: 22, pp. 1734-1736.

(Continued)

*Primary Examiner* — Howard Williams

(74) *Attorney, Agent, or Firm* — IP Tech Law

(57) ABSTRACT

Implementations of antennas may include a meandering T-matching structure, a first meandering feed line coupled to the meandering T-matching structure, and a first radiating part coupled to the first meandering feed line. Implementations may include a second meandering feed line coupled to the meandering T-matching structure, and a second radiating part coupled to the meandering feed line. A gap may physically separate the first meandering feed line and the second meandering feed line.

16 Claims, 7 Drawing Sheets

(51) Int. Cl.

| | |
|---|---|
| ***H01Q 9/24*** | (2006.01) |
| ***H01Q 9/26*** | (2006.01) |
| ***H01Q 5/364*** | (2015.01) |

(56) References Cited

U.S. PATENT DOCUMENTS

| | | | | |
|---|---|---|---|---|
| 8,564,439 | B2 | 10/2013 | Deavours | |
| 2005/0024287 | A1 | 2/2005 | Jo et al. | |
| 2006/0145927 | A1 | 7/2006 | Choi | |
| 2007/0200705 | A1* | 8/2007 | Yamagajo | G06K 19/0726 340/572.7 |
| 2008/0143535 | A1* | 6/2008 | Fischer | H01Q 1/2225 340/572.7 |
| 2009/0160653 | A1 | 6/2009 | Yeh | |
| 2012/0018524 | A1 | 1/2012 | Loi et al. | |
| 2013/0050047 | A1* | 2/2013 | Carr | H01Q 1/248 343/853 |

OTHER PUBLICATIONS

"High-Temperature UHF RFID Sensor Measurements in a Full-Metal Environment, Michael Heiss; Ralf Hildebrandt, Smart Objects, Systems and Technologies (SmartSysTech)," Proceedings of 2013 European Conference on Year: 2013, pp. 1-5.

"Meander Dipole Antenna design for Passive UHF RFID Tags," Tang Fang-Mei, Li Jian-Cheng, and Li Cong, College of Electronic Technology and Engineering National University of Defense Technology, Changsha410003, China.

Y. Tikhov, Y. Kim and Y.-H. Min, "Compact Low Cost Antenna for Passive RFID Transponder," IEEE International Symposium on Antennas and Propagation Digest, Albuquerque, NM, Jul. 2006, pp. 10 15-1018.

"Metal Mountable UHF-RFID Tag Antenna with Meander Feed Line and Double T-Match," N.M.Faudzi, M.T.Ali, I.Ismail, H.Jumaat, N.H.M.Sukaimi, Antenna Research Group (ARG), Microwave Technology Centre (MTC), Faculty of Electrical Engineering (FKE) Universiti Teknologi Mara (UiTM), Shah Alam Selangor, Malaysia.

Extended European Search Report, European Patent Application No. 17184457.4, dated Jan. 4, 2018, 12 pages.

* cited by examiner

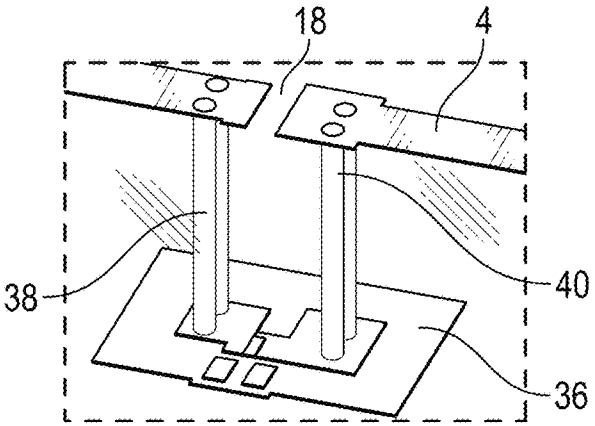
FIG. 3
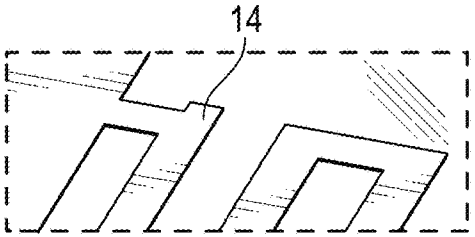
FIG. 2
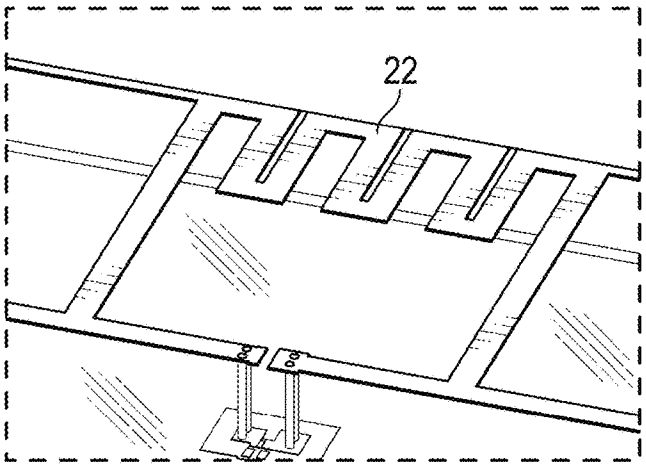
FIG. 4
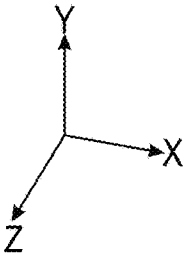

RADIO FREQUENCY IDENTIFICATION (RFID) TAG DEVICE AND RELATED METHODS

CROSS REFERENCE TO RELATED APPLICATIONS

This document claims the benefit of the filing date of U.S. Provisional Patent Application 62/383,226, to Jordan Davis which was filed on Sep. 2, 2016, the disclosure of which is hereby incorporated entirely herein by reference.

BACKGROUND

1. Technical Field

Aspects of this document relate generally to radio frequency devices, such as antennas for radiating frequencies. More specific implementations involve ultra-high frequency (UHF) radio frequency identification (RFID) tags and antennas used for sensing temperature.

2. Background

Conventionally, RFID technology is used to send and receive identifying information using radio waves. RFID tags generally include a chip, memory to store electronic information, and an antenna to transmit the stored data.

SUMMARY

Implementations of antennas used in systems disclosed herein may include a meandering T-matching structure, a first meandering feed line coupled to the meandering T-matching structure, a first radiating part coupled to the first meandering feed line, a second meandering feed line coupled to the meandering T-matching structure, and a second radiating part coupled to the meandering feed line. A gap may physically separate the first meandering feed line and the second meandering feed line.

Implementations of antennas may include one, all, or any of the following:

The first meandering feed line may include a first frequency tuning stub.

The second meandering feed line may include a second frequency tuning stub.

One of the first radiating part and the second radiating part may include a power transfer portion.

Implementations of radio frequency identification (RFID) tags may include a dielectric substrate including a first side and a second side, a ground plane coupled to the first side of the dielectric substrate, wherein the ground plane may include a metal exclusion region, and an antenna coupled to the second side of the dielectric substrate. The antenna may be coupled to the metal exclusion region through a first via and a second via in the dielectric substrate, and an integrated circuit coupled to the first side of the dielectric substrate.

Implementations of RFID tags may include one, all, or any of the following:

The dielectric substrate may be 3.2 millimeters thick.

The dielectric substrate may be 1.6 millimeters thick.

The antenna may include a meandering T-matching structure.

The antenna may include a first frequency tuning stub and a second frequency tuning stub.

Implementations of radio frequency identification (RFID) tags may include a dielectric substrate including a first side and a second side, a ground plane coupled to the first side of the dielectric substrate, wherein the ground plane may include a metal exclusion region, and an antenna coupled to the second side of the dielectric substrate. The antenna may include a meandering T-matching structure, a first meandering feed line coupled to the meandering T-matching structure, a first radiating part coupled to the first meandering feed line, a second meandering feed line coupled to the meandering T-matching structure, and a second radiating part coupled to the second meandering feed line. A gap may physically separate the first meandering feed line and the second meandering feed line. The antenna may also be coupled to the metal exclusion region through a first via and a second via, the first via positioned at a first side of the gap and the second via positioned at a second side of the gap. The RFID tag may also include an integrated circuit coupled to the dielectric substrate.

Implementations of RFID tags may include one, all, or any of the following:

The integrated circuit may be coupled to the first side of the dielectric substrate.

The integrated circuit may be coupled to the second side of the dielectric substrate.

The integrated circuit may span the gap between the first meandering feed line and the second meandering feed line.

The antenna may include a first frequency tuning stub coupled to the first meandering feed line.

The antenna may include a second frequency tuning stub coupled to the second meandering feed line.

The dielectric substrate may be 3.2 millimeters thick.

The dielectric substrate may be 1.6 millimeters thick.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and:

FIG. 2 is a magnified view of a frequency tuning stub implementation as illustrated in FIG. 1;

FIG. 3 is a magnified see through view of a gap in the antenna implementation of FIG. 1 with vias coupling the antenna to a metal exclusion region through a substrate;

FIG. 4 is a magnified see through view of a T-matching structure implementation illustrated in FIG. 1;

DESCRIPTION

This disclosure, its aspects and implementations, are not limited to the specific components, assembly procedures or method elements disclosed herein. Many additional components, assembly procedures and/or method elements known in the art consistent with the intended radio frequency identification (RFID) tag device will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such RFID tag devices, and implementing components and methods, consistent with the intended operation and methods.

Figure 1:
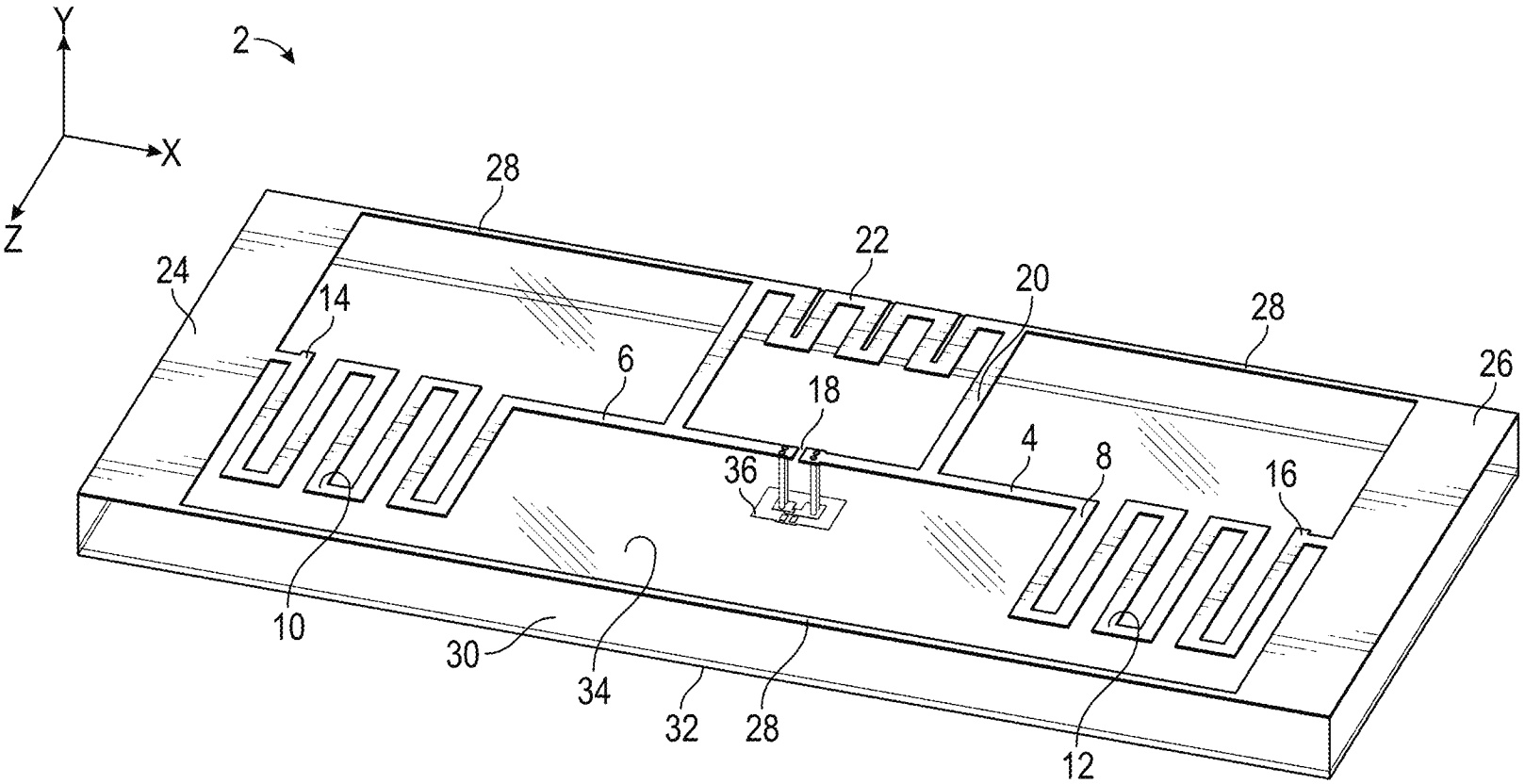
FIG. 1 is a perspective see through view of a radio frequency identification (RFID) tag.

Referring to FIG. 1, a perspective see through view of an RFID tag is illustrated. The RFID tag 2 include an antenna 4. The antenna 4 illustrated in FIG. 1 is a dipole antenna. In particular implementations, the antenna may be symmetrical. Symmetry, as used in this document, may refer to reflectional symmetry, rotational symmetry, translational symmetry, or any combination of all or part of these symmetries. In other implementations, the antenna may not have symmetry.

In implementations with a dipole antenna, the antenna 4 includes a first dipole arm 6 and a second dipole arm 8. In various implementations, like the implementation illustrated by FIG. 1, the first dipole arm 6 may include a first meandering feed line 10 and the second dipole arm 8 may include a second meandering feed line 12. In various implementations, the first meandering feed line 10 and the second meandering feed line 12 may include any number of bends within the meandering portion of the meandering feed lines. The first meandering feed line 10 and the second meandering feed line 12 may be symmetrical with respect to each other or may be asymmetrical in various implementations.

The first dipole arm may include a first frequency tuning stub 14. In various implementations, the frequency tuning stub may be coupled to or part of an end portion of the dipole arm that is near the outer perimeter of the antenna, a middle portion of the dipole arm, or an end portion of the dipole arm that is near the center of the antenna. Referring to FIG. 2, a magnified view of a frequency tuning stub of FIG. 1 is illustrated. The first frequency tuning stub 14 may extend from the first dipole arm 6. The tuning stub may vary in size Referring back to FIG. 1, the second dipole arm 8 may include a second frequency tuning stub 16. In various implementations, the frequency tuning stub 16 may be coupled to or part of an end portion of the dipole arm that is near the outer perimeter of the antenna, a middle portion of the dipole arm, or an end portion of the dipole arm that is near the center of the antenna. The second frequency tuning stub 16 may extend from the second dipole arm 8. The tuning stub may vary in size. The first frequency tuning stub 14 and the second frequency tuning stub 16 may be symmetrical with respect to each other, and/or they may be located in the antenna in a position that allows the first dipole arm 6 to be symmetrical to the second dipole arm 8.

By including a frequency tuning stub, fine tuning of resonant frequency response is possible. Longer stubs lead to lower resonant frequencies and shorter stubs lead to higher resonant frequencies. The frequency tuning stub provides another degree of freedom when altering/adjusting/calibrating the antenna for a particular frequency band or radio frequency integrated circuit (RFIC). The second frequency tuning stub 16 may be similar to or the same as the first frequency tuning stub 14. Use of a frequency tuning stub may permit the antenna to be used, during manufacturing, to determine what the range of RF frequencies that the ultimate RFID device will respond to. This capability, to tune the antenna during manufacturing to a fixed RF frequency range may improve device performance and reliability over the long term (as no additional tuning components that may fail over time are involved).

The antenna 4 may include a gap 18 that physically separates the first dipole arm 6 from the second dipole arm 8. Gap 18 represents a physical break in the material forming the first dipole arm 6 from the material of the second dipole arm 8. Gap 18 also likewise physically separates the first meandering feed line 10 from the second meandering feed line 12. Referring to FIG. 3, a magnified view of the gap shown in FIG. 1 is illustrated. The gap may vary in dimension as a function of package size and other package design variables.

Referring back to FIG. 1, the antenna 4 includes a T-matching network 20 to adjust the impedance and provide a conjugate match to a RFIC for maximum power transfer. The T-matching structure 20 may be coupled to both the first dipole arm 6 and the second dipole arm 8. In various implementations, the T-matching network may be, by non-limiting example, a straight rectangular T-matching structure, a circular T-matching structure, a double T-matching structure, or, as illustrated in FIG. 1, a meandering T-matching structure 22. Referring to FIG. 4, a magnified view of the T-matching structure of FIG. 1 is illustrated. In implementations with a meandering T-matching structure, the meandering T-matching structure 22 may include any number of bends. In various implementations, the T-matching structure may include the same, more, or fewer number of bends as the bends in the first meandering feed line or in the second meandering feed line. The bends may provide a wide range of conjugate matches to be used with an RFIC. The meandering T-matching structure 22 may be symmetrical about the middle of the meandering T-matching structure 22.

Referring back to FIG. 1, the antenna 4 may include a first radiating part 24 and a second radiating part 26. The first radiating part 24 and the second radiating part 26 may transmit and/or receive signals. In various implementations, the first radiating part 24 may be coupled to the first meandering feed line 10. In others, the second radiating part 26 may be coupled to the second meandering feed line 12. The first radiating part 24 and the second radiating part 26 may be symmetrical with respect to one another.

In various implementations, the first radiating part 24 and/or the second radiating part 26 may include a power transfer portion. In such implementations, the first meandering feed line 10 or the second meandering feed line 12 may provide power from the power transfer portion to an integrated circuit (IC). In this way, the IC is provided with the power to operate through the RF signal being received from an RF transmitter, which may provide power on a temporary basis (in the case of transient RF signals) or long-term basis (in the case of steady RF signals).

In various implementations, the antenna 4 may include a loop 28 which couples the outermost portions of the antenna together and forms a perimeter around the inner portions of the antenna. The loop 22 may be a rectangular loop and may directly couple the first radiating part 18 with the second radiating part 20, couple the first radiating part 18 with the T-matching structure 14, and couple the second radiating part 20 with the T-matching structure 14. In other implementations, however, the loop may not directly connect any one of these structures together.

The RFID tag device 2 includes a substrate. The substrate may be a dielectric substrate 30 with a first side 32 and a second side 34. As illustrated in FIG. 1, the first side 32 is illustrated as the bottom of the substrate 30 and the second side 34 is illustrated as the top of the substrate 30. The substrate illustrated in FIG. 1 is rectangular, but in various implementations, the substrate may have other shapes, including, by non-limiting example, circular, square, triangular, or any other closed shape. In implementations with a meandering T-matching structure, the antenna may be tuned to work properly with a variety of dielectric substrates made of various materials and having various thicknesses. In one implementation, a dielectric substrate that is 3.2 millimeters thick may be used with an implementation of an antenna like that illustrated as antenna 4. Specifically, in particular implementations, the substrate used may be a 3.2 micrometer (micron) thick substrate made of FR-4. In other implementations, the substrate may be 1.6 millimeters thick. Specifically, substrates that are 1.6 micrometer thick substrate marketed under the tradename RO4350TM by Rogers Corporation of Chandler, Ariz. In still other implementations, the dielectric substrate 30 may include other materials and/or have other thicknesses than described above.

The RFID tag may include a ground plane coupled to the first side 32 of the substrate 30. In various implementations, the ground plane may be a metallic or conductive material. The ground plane may include a metal exclusion region 36 coupled to the first side 32 of the substrate 30. In various implementations, the metal exclusion regions may include mounting pads which may couple to vias. The mounting pads within the metal exclusion region are directly coupled to the first side of the substrate 30, while in other implementations the mounting pads within the metal exclusion region 36 are not directly coupled to the first side 32 of the substrate. Referring back to FIG. 3, a magnified view of the metal exclusion region 36 is illustrated. The metal exclusion region 36 may vary in size and shape. In various implementations, the distance from the ground plane coupled to the first side 32 of the substrate 30 to the mounting pads within the metal exclusion regions may vary. A second order effect on the conjugate match to the RFIC may be created by varying this distance from the ground plane. The mounting pads within the metal exclusion region 36 may be coupled to the antenna 4 through a first via 38 that goes through the material of the substrate 30 and through a second via 40 that goes through the substrate 30. The first via 38 may utilize the metal exclusion region 36 to form a conjugate match of the first dipole arm 6 near the gap 18 to an RFIC. The second via 40 may utilize the metal exclusion region 36 to form a conjugate match 36 of the second dipole arm 8 near the gap 18 to an RFIC.

Figure 5:
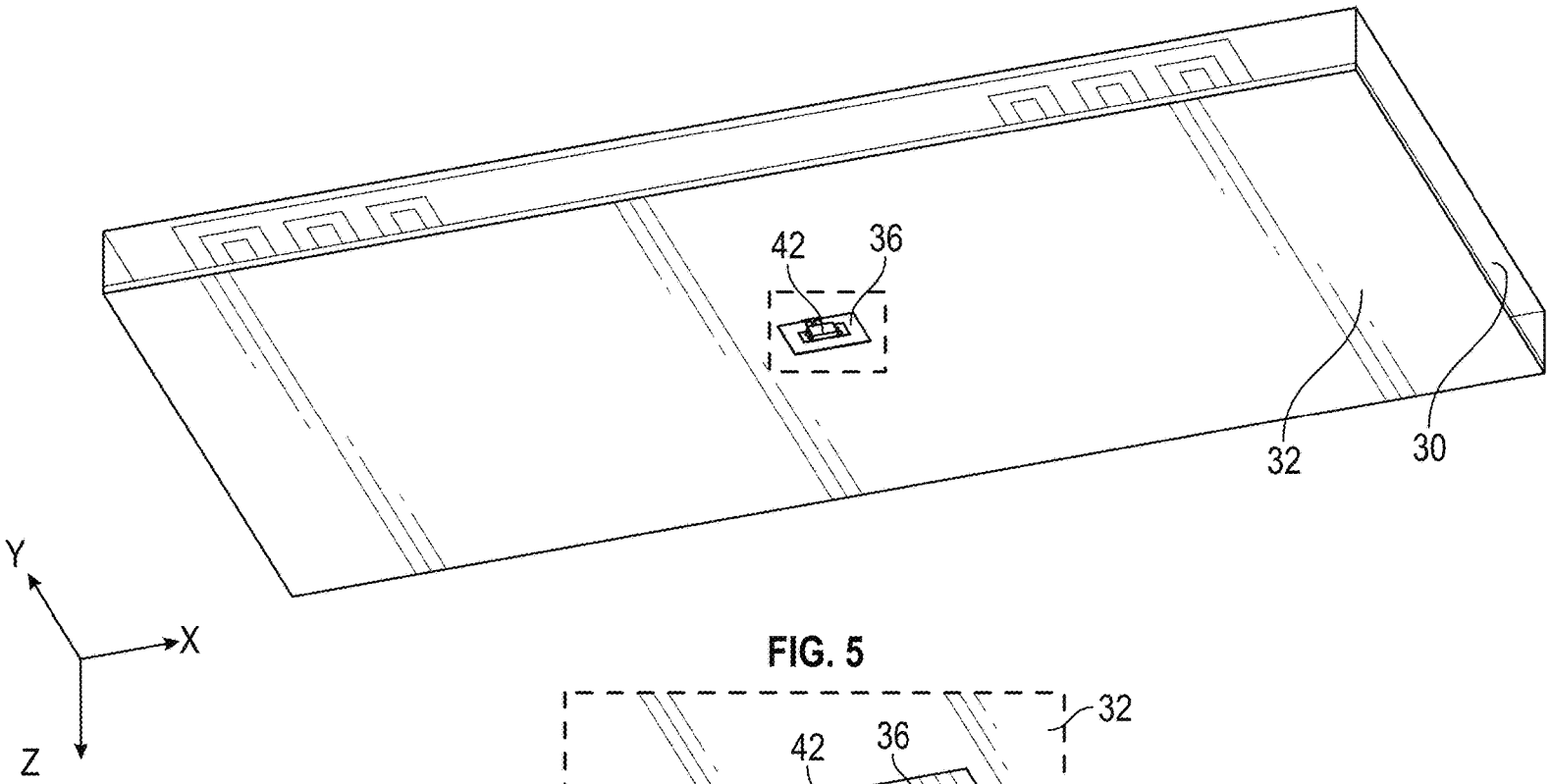
FIG. 5 is a bottom partial see through view of an RFID tag implementation with an integrated circuit (IC) on the same side of the substrate as a metal exclusion region.
Figure 6:
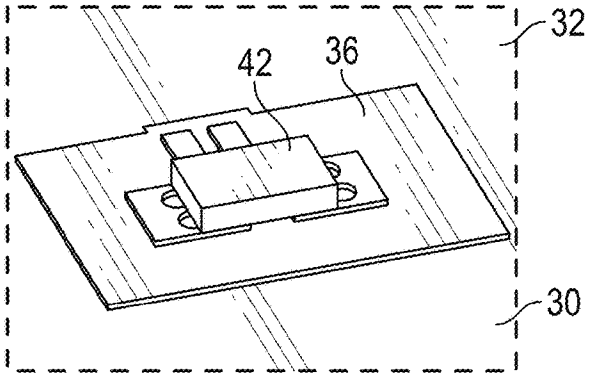
FIG. 6 is a magnified view of the IC illustrated in FIG. 5.

Referring to FIG. 5, a bottom partial see through view of an RFID tag with an integrated circuit (IC) on the same side of the substrate as the metal exclusion region is illustrated. FIG. 6 is a magnified view of the IC of FIG. 5 at the area marked 4B in FIG. 5. In various implementations, an IC 42 may be coupled to the first side 32 of the substrate. The IC 42 electrically communicates with antenna 4 through vias 38 and 40.

Figure 7:
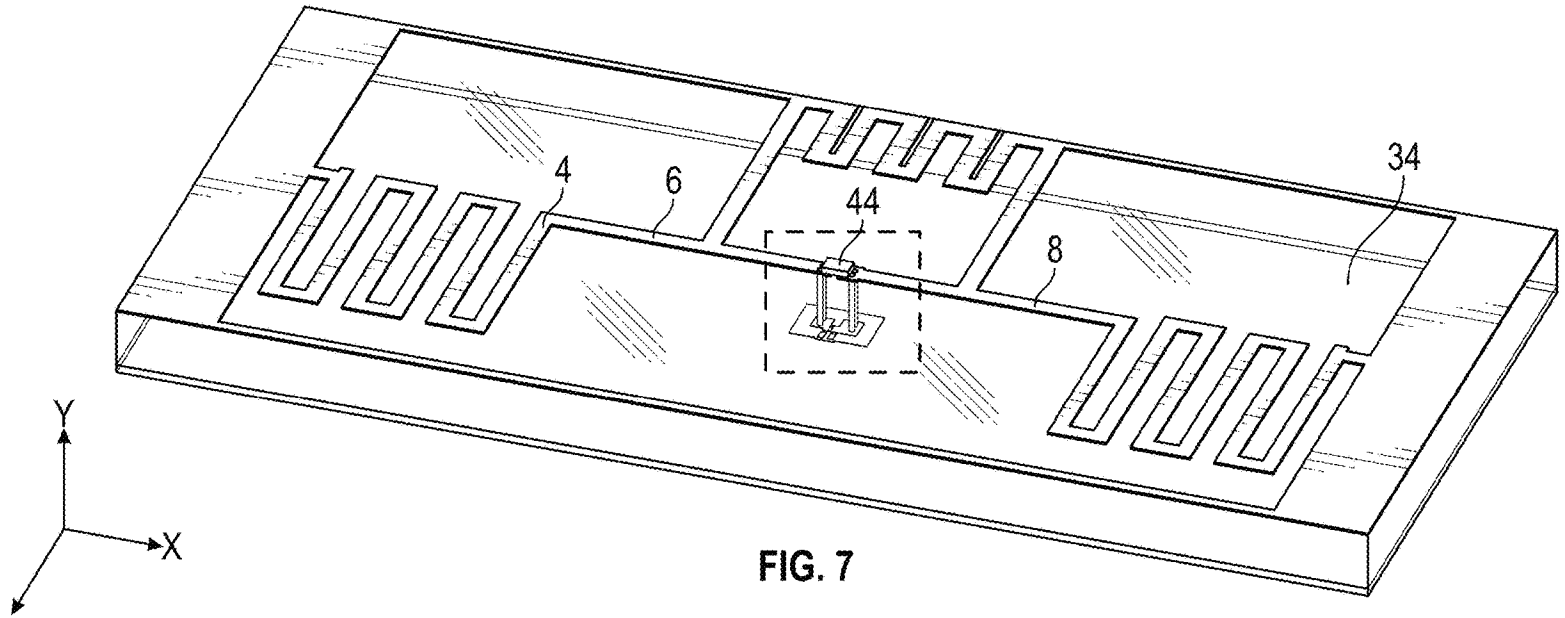
FIG. 7 is a perspective see through view of an RFID tag implementation with an IC implementation located on the same side of the substrate as the antenna.
Figure 8:
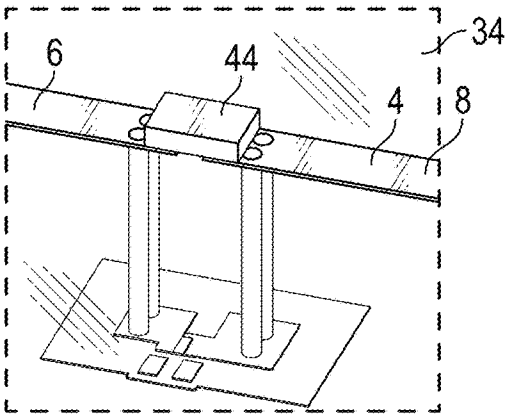
FIG. 8 is a magnified view of the IC implementation of FIG. 7.

Referring to FIG. 7, a perspective see through view of an RFID tag with an IC on the same side of the substrate as the antenna is illustrated. FIG. 8 is a magnified view of the IC of FIG. 7 at the area marked 3B in FIG. 7. In the implementation illustrated by FIGS. 7 and 8, an IC 44 may be coupled to a second side 34 of the dielectric substrate 30. In such implementations, the IC 44 may span the gap 18 between the first meandering feed line and the second meandering feed line. The IC 44 may also be directly coupled to the antenna 4, specifically directly to the first dipole arm 6 and the second dipole arm 8. The IC 44 may be bonded to the substrate through the first dipole arm 6 and the second dipole arm 8 in various implementations. In others, additional bonding material, including electrically/thermally conductive and/or non-conductive materials may be used to further secure the IC to the substrate.

Figure 9:
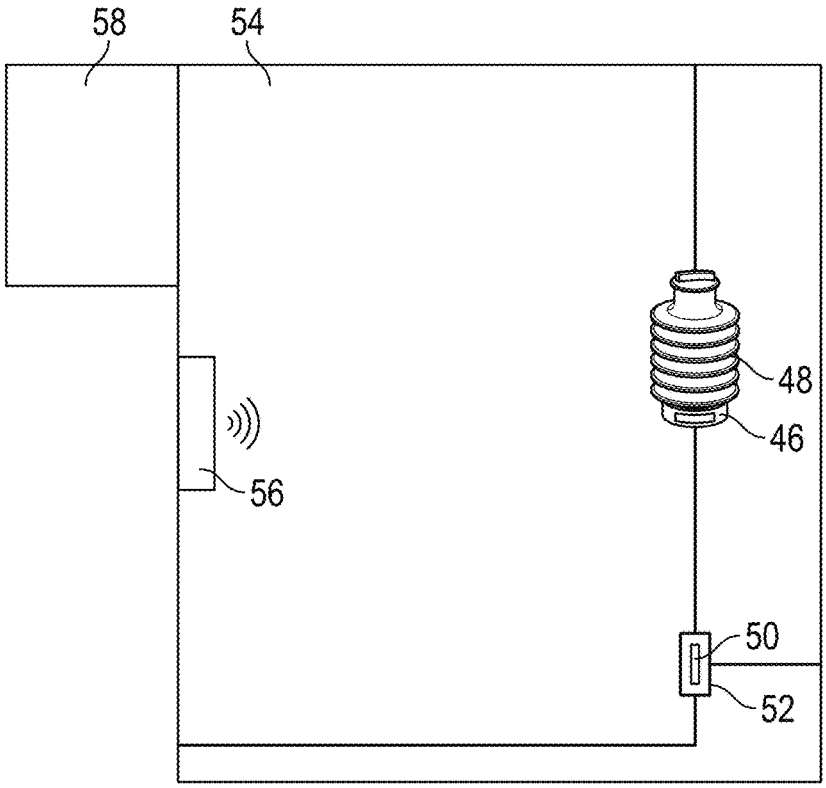
FIG. 9 is a schematic showing two RFID tags coupled to temperature sensors in use in an RFID temperature sensing system implementation.

In various implementations, the RFID tag may be used as a component in a system for sensing temperature. FIG. 9 is a schematic showing two RFID tags in use in such a system implementation. A first RFID tag 46 used as a temperature sensor may be placed on an insulator 48. A second RFID tag 50 used as a temperature sensor may be placed on a busbar 52. In other implementations, the RFID tags may be placed on and measure the temperature of any additional system components. In the implementation illustrated by FIG. 9, the RFID tags, the insulator 48, and the busbar 52 are all within an equipment enclosure 54. A radio frequency (RF) antenna 56 is also be placed within the equipment enclosure 54 to wirelessly communicate with/power the first RFID tag 46 and the second RFID tag 50. An RFID interrogator 58 may be placed outside the equipment enclosure 54 to read the information provided by the RFID tags through the RF antenna 56. In the implementation illustrated by FIG. 9, two RFID tags were used, however, in other systems a single RFID tag may be used or more than two RFID tags may be used.

In implementations where the RFID tag is used for sensing temperature, the structure of the RFID tag as described above increases both the accuracy and the speed of the response time of the temperature sensor. The response time of detecting a temperature change using the IC may be shortened from seconds to milliseconds. Furthermore, the necessity for temperature offset due to the insulative nature of the substrate may also eliminated. Further, there is less interference with the temperature reading from ambient temperatures. All of the foregoing effects may increase the accuracy of the temperature sensor.

For the sensor implementations illustrated in FIG. 9, the temperature sensing accuracy is +/−0.3 degrees Celsius when measuring temperatures between 0-50 degrees Celsius, and +/−1 degree Celsius when measuring temperatures between −40-0 degrees Celsius and 50-80 degrees Celsius.

The RFID tags may be used to monitor the temperature of computer servers, monitor power lines, power distribution system components, or monitor any other device or system where temperature is important. Further, due to the structure of the RFID tag as described above, the RFID tag may be used on metal or highly conductive surfaces. Thus, this application may be useful in any application where a temperature of a metallic object needs constant remote monitoring.

In other implementations, the RFID tag and antenna may be used in applications different from temperature sensing, such as, by non-limiting example, tracking applications, inventory management, and access control applications. This may be done through using an antenna like those disclosed herein with and IC coupled with/containing another sensor type, such as a pressure, flow, current, or other sensor.

Figure 10:
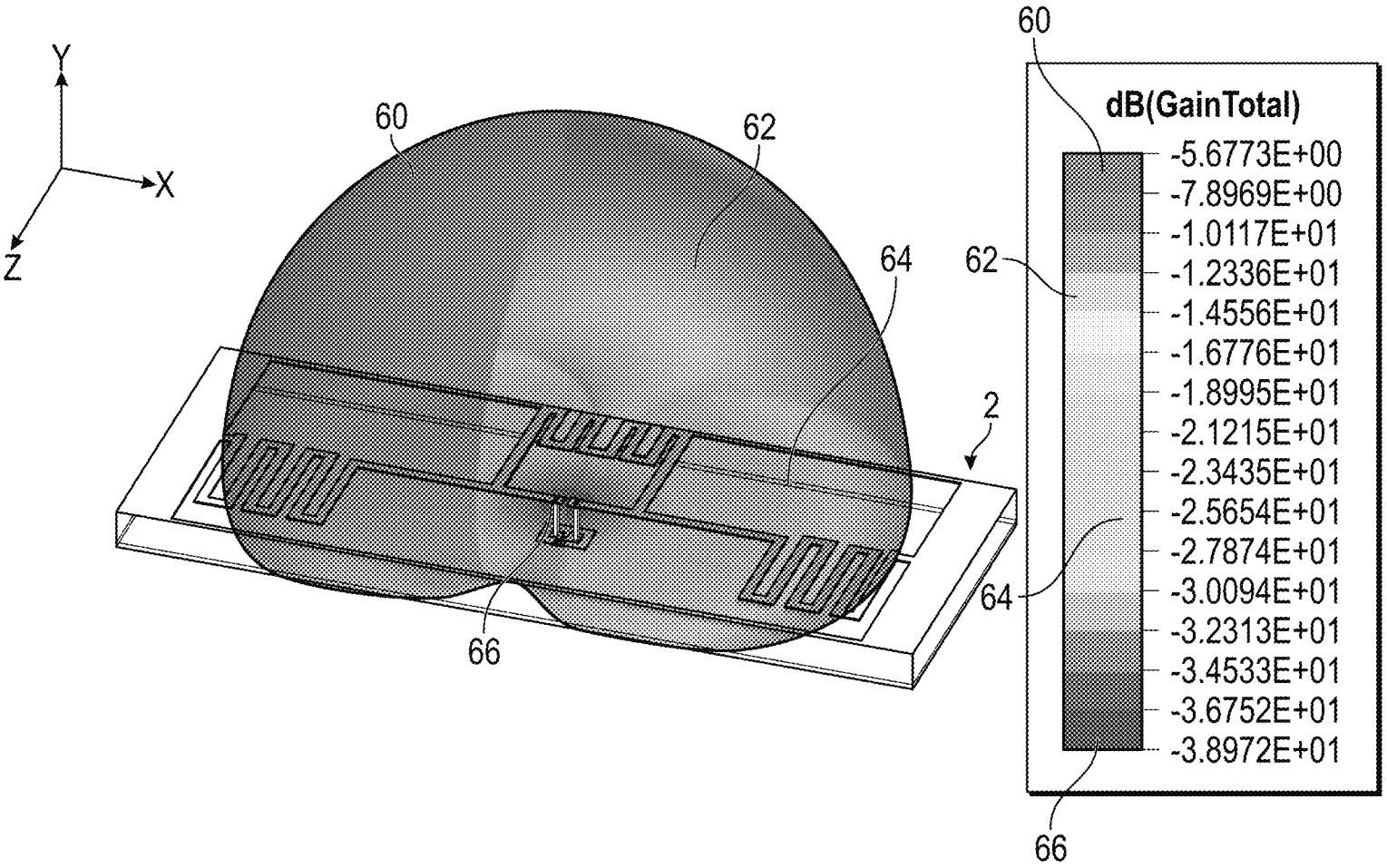
FIG. 10 is an illustration of the far-field gain response of the RFID tag implementation illustrated in FIG. 1 with an associated table showing the corresponding gain values.

FIG. 10 is an illustration of the far-field gain response of the RFID tag implementation illustrated in FIG. 1 with an associated table showing the corresponding gain values in dB. In a color version of FIG. 10, red would be represented by 60, yellow would be represented by 62, green would be represented by 64, and blue would be represented by 66.

Figure 11:
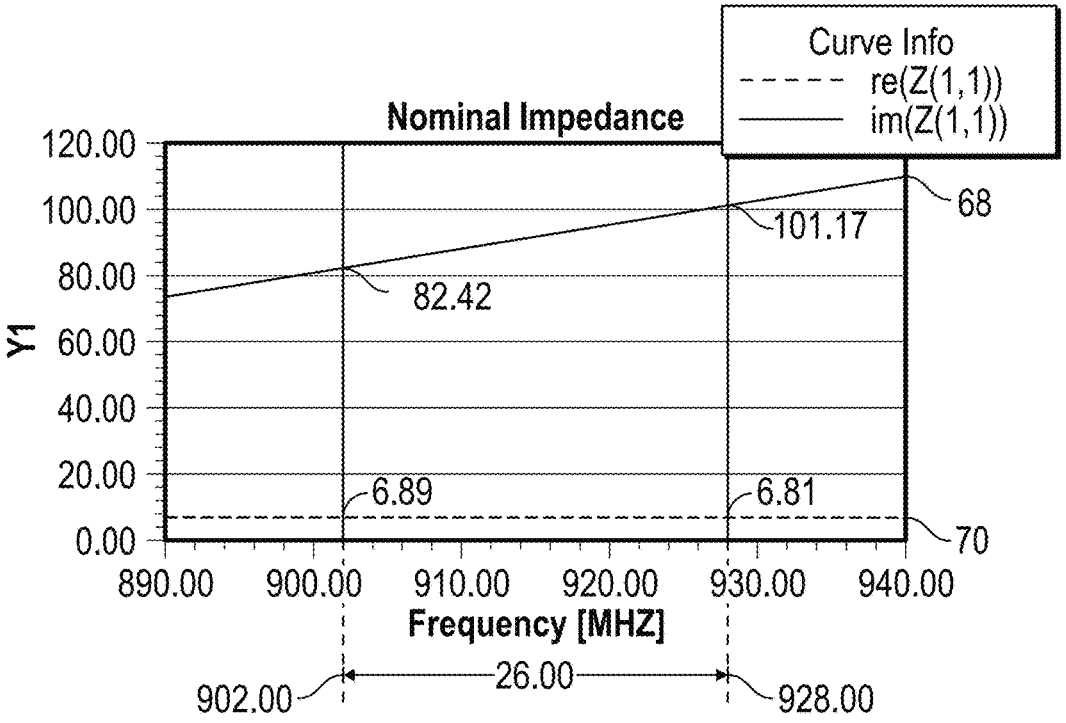
FIG. 11 is a chart showing the frequencies that correspond with the nominal impedance for various antenna implementations like those disclosed herein.

FIG. 11 is a chart showing the frequencies that correspond with the nominal impedance. A first curve 70 shows the real component of the nominal impedance of the RFID device of FIG. 1. The second curve 68 illustrates the imaginary component of the nominal impedance of the RFID tag. As can be seen from the chart, the RFID device has an optimal nominal impedance between the frequencies of 902 MHZ and 928 MHZ.

Figure 12:
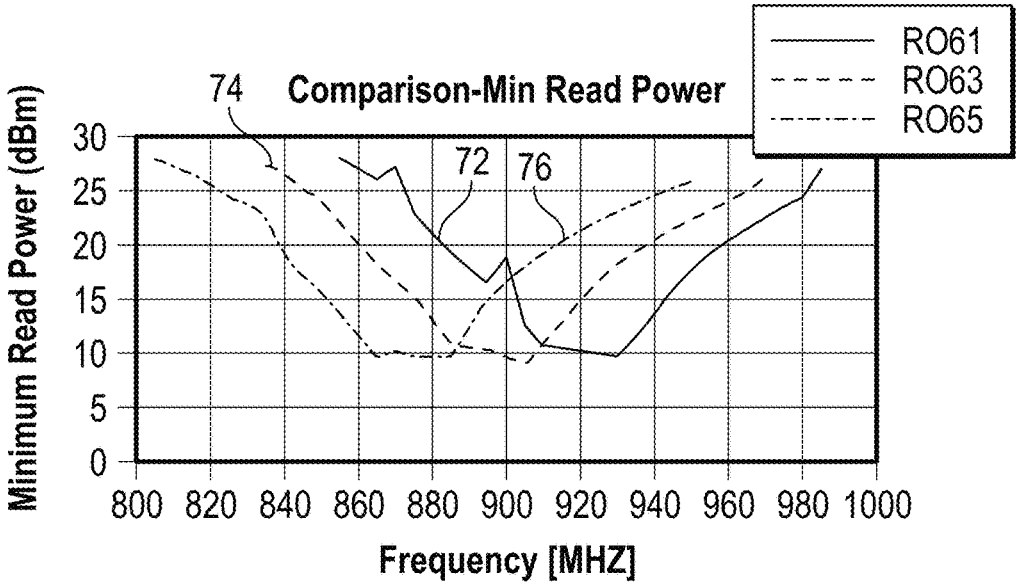
FIG. 12 is a chart showing the minimum read power measurements of three different RFID tags using an antenna implementation like those disclosed herein, each having a different physical length.

FIG. 12 is a chart showing the minimum read power measurements of three different RFID tags, each with a different overall length. A first RFID tag 72 included a design marketed under the name RO61. The read power using the first RFID tag is at a minimum between approximately 865 MHZ and 888 MHZ. A second RFID tag 74 included a design marketed under the name RO63. As can be seen, the read power using the second RFID tag is at a minimum between approximately 890 MHZ and 910 MHZ. A third RFID tag 76 included a design marketed under the name RO65. The read power using the third RFID tag is at a minimum between approximately 910 MHZ and 935 MHZ. This data indicates that the effect of the design length can be used to alter the operational frequency to any specific regional band within but not limited to the ultra-high frequency (UHF) operating band, while the shape of the curve remains relatively stable across the different designs. This indicates that antenna designs like those disclosed here may be versatile and easily modified to meet any specific geographic band needs.

In places where the description above refers to particular implementations of antennas, RFID tags and implementing components, sub-components, methods and sub-methods, it should be readily apparent that a number of modifications may be made without departing from the spirit thereof and that these implementations, implementing components, sub-components, methods and sub-methods may be applied to other antennas and RFID tags.

What is claimed is:

1. An antenna comprising:

a meandering T-matching structure;

a first meandering feed line coupled to the meandering T-matching structure;

a first radiating part coupled to the first meandering feed line;

a second meandering feed line coupled to the meandering T-matching structure; and a second radiating part coupled to the second meandering feed line;

wherein a gap physically separates the first meandering feed line and the second meandering feed line.

2. The antenna of claim 1, wherein the first meandering feed line comprises a first frequency-tuning stub.

3. The antenna of claim 2, wherein the second meandering feed line comprises a second frequency-tuning stub.

4. The antenna of claim 1, wherein one of the first radiating part and the second radiating part comprises a power transfer portion.

5. A radio frequency identification (RFID) tag comprising:

a dielectric substrate comprising a first side and a second side;

a ground plane coupled to a first side of the dielectric substrate, wherein the ground plane comprises a metal exclusion region;

an antenna coupled to the second side of the dielectric substrate, wherein the antenna is coupled to the metal exclusion region through a first via and a second via in the dielectric substrate;

wherein the antenna comprises a meandering T-matching structure; and an integrated circuit coupled to the first side of the dielectric substrate.

6. The RFID tag of claim 5, wherein the dielectric substrate is 3.2 millimeters thick.

7. The RFID tag of claim 5, wherein the dielectric substrate is 1.6 millimeters thick.

8. The RFID tag of claim 5, wherein the antenna comprises a first frequency tuning stub and a second frequency tuning stub.

9. A radio frequency identification (RFID) tag comprising:

a dielectric substrate comprising a first side and a second side;

a ground plane coupled to a first side of the dielectric substrate, wherein the ground plane comprises a metal exclusion region;

an antenna coupled to the second side of the dielectric substrate, the antenna comprising:

a meandering T-matching structure;

a first meandering feed line coupled to the meandering T-matching structure;

a first radiating part coupled to the first meandering feed line;

a second meandering feed line coupled to the meandering T-matching structure; and a second radiating part coupled to the second meandering feed line;

wherein a gap physically separates the first meandering feed line and the second meandering feed line;

wherein the antenna is coupled to the metal exclusion region through a first via and a second via, the first via positioned at a first side of the gap and the second via positioned at a second side of the gap; and an integrated circuit coupled to the dielectric substrate.

10. The RFID tag of claim 9, wherein the integrated circuit is coupled to the first side of the dielectric substrate.

11. The RFID tag of claim 9, wherein the integrated circuit is coupled to the second side of the dielectric substrate.

12. The RFID tag of claim 11, wherein the integrated circuit spans the gap between the first meandering feed line and the second meandering feed line.

13. The RFID tag of claim 9, wherein the antenna further comprises a first frequency tuning stub coupled to the first meandering feed line.

14. The RFID tag of claim 13, wherein the antenna further comprises a second frequency tuning stub coupled to the second meandering feed line.

15. The RFID tag of claim 9, wherein the dielectric substrate is 3.2 millimeters thick.

16. The RFID tag of claim 9, wherein the dielectric substrate is 1.6 millimeters thick.

* * * * *